United States Patent [19]

Fischer

[11] Patent Number: 4,662,277

[45] Date of Patent: May 5, 1987

[54] ROTARY PRINTING MACHINE WITH SHEET REVERSAL AND TRANSPORT APPARATUS

[75] Inventor: Hermann Fischer, Augsburg, Fed. Rep. of Germany

[73] Assignee: M.A.N.-Roland Druckmaschinen Aktiengesellschaft, Augsburg, Fed. Rep. of Germany

[21] Appl. No.: 756,399

[22] Filed: Jul. 17, 1985

[30] Foreign Application Priority Data

Jul. 20, 1984 [DE] Fed. Rep. of Germany ..... 3426756

[51] Int. Cl.[4] ..... B41F 21/06

[52] U.S. Cl. ..... 101/230; 101/246; 101/409

[58] Field of Search ..... 101/230, 246, 382 MV, 101/408, 409

[56] References Cited

U.S. PATENT DOCUMENTS

| | | | |
|---|---|---|---|
| 1,870,543 | 8/1932 | Wood | 101/409 X |
| 3,654,861 | 4/1972 | Rudolph et al. | 101/409 X |
| 4,029,009 | 6/1977 | Kühn et al. | 101/409 X |
| 4,372,209 | 2/1983 | Jentzsch et al. | 101/409 |

FOREIGN PATENT DOCUMENTS

| | | | |
|---|---|---|---|
| 653558 | 12/1962 | Canada | 101/409 |
| 1262294 | 3/1968 | Fed. Rep. of Germany . | |
| 2337296 | 2/1974 | Fed. Rep. of Germany | 101/409 |
| 0143150 | 8/1980 | German Democratic Rep. | 101/409 |

*Primary Examiner*—Clifford D. Crowder

*Attorney, Agent, or Firm*—Frishauf, Holtz, Goodman & Woodward

[57] ABSTRACT

Register of sheets being transferred by a reversal drum (9), having suction grippers (16) to grip the trailing end (15) of a sheet (12) being transported and reversed between two printing stations (1, 2) is improved and assisted by positioning pricking pins (17) in or on the suction grippers (16), to prick into and engage the trailing end portions of the sheet being picked off an impression cylinder (5) of a first printing system (1) by the reversal and transport drum (9).

10 Claims, 2 Drawing Figures

1
2
3
4
5
6
7
8
9
10
11
12
12'
12"
13
13'
14
15
15'
15"
16
16'
16"
17

5
12
15
16
17
18
19

ROTARY PRINTING MACHINE WITH SHEET REVERSAL AND TRANSPORT APPARATUS

The present invention relates to rotary printing machines, and more particularly to a sheet reversal and transport apparatus, interposed between two printing stations in order to reverse a sheet being fed to one printing station, so that the reverse side of the sheet can then be printed; and more particularly to such an apparatus capable of handling heavy sheets, such as cardboard and the like.

BACKGROUND

Various types of transport and reversal apparatus have been proposed, in order to transport the sheet from one printing station to another and, during the transport, reversing the face of the sheet so that the sheet is turned over in its path between succeeding printing stations. One such apparatus—described, for example, in German Pat. No. 12 62 294—utilizes printing stations having plate and/or rubber blanket cylinders of a predetermined diameter, and an impression or printing cylinder of twice the diameter. The impression or printing cylinder is formed with grippers to grip the leading sheets being passed between the printing cylinder or the rubber blanket cylinder and the impression cylinder. The transport and reversal cylinder, likewise, has twice the diameter of the plate and/or rubber blanket cylinder.

A transfer and reversal drum or cylinder is located between the impression cylinders of the respective printing stations. The apparatus functions in this manner: For reversal of a sheet gripped by the grippers of the impression cylinders, the transfer cylinder is spaced slightly from the impression cylinder and, as the sheet passes along the transfer cylinder, the trailing end portion of the sheet is gripped by the reversal and transport cylinder. Gripping, usually, is carried out by suction grippers, since placement of mechanical grippers to catch the trailing edge or end portion of a sheet is difficult if sheets of various lengths have to be handled. The reversing and transport drum or cylinder then transports the sheet to the second printing station, the reversal cylinder gripping the previously trailing edge of the sheet which, now, forms the leading edge of the sheet as it is applied to the second printing station.

The sheets may have different lengths, and it is therefore not possible to utilize the mechanical gripper system on the reversal and transport cylinder which can accomodate various lengths of sheets. This is due to the construction of mechanical grippers which customarily grip behind the edge of the sheet to be engaged. It would only be possible to accomodate various lengths of sheets if, in the impression cylinder, grooves were to be cut to match the gripper position to respective sheets. This, however, cannot be done for printing reasons, since stripes might form on the printed subject matter.

To reverse and transport a sheet, therefore, it has been proposed to utilize suction grippers which can engage the trailing zone of a sheet, rather than being placed to accurately grip an edge thereof. German Pat. No. 12 62 294 describes such a suction gripper arrangement. The suction grippers engage the sheet in the rear or trailing end region or zone, lift off the end region or zone and, by a simple pivoting movement, pivot the rear sheet edge or zone into the interior of the transfer cylinder, thereby lifting the trailing end portion or zone of the sheet off the prior impression cylinder. The end zone of the sheet can then be transferred to a customary mechanical gripper, since the cylinder has rotated in the meanwhile, the grippers then no longer being in danger of collision with the impression cylinder.

The system works satisfactorily with thin substrate sheets; when handling heavy or stiff substrates, however, such as cardboard, "Bristol board" or the like, substantial force must be applied on the suction grippers. The sheet is stressed, and the forces transferred to the sheet must accomodate the sheet, since the sheet first must be braked with respect to its original direction of movement, and then the direction of movement reversed. Even slight slippage between the suction grippers and the end zone of the sheet, thus, may interfere with proper register and decrease the quality of printing in the subsequent printing station with respect to the first printing station.

THE INVENTION

It is an object to improve a sheet reversal apparatus of the type in which suction grippers are used to engage the trailing end of sheets, which, thus, may be used with substrates of varying lengths, and which is capable of handling heavy printing stock or substrates, without slip, so that register can be precisely maintained.

Briefly, the suction grippers are provided, additionally, with pricking pins which assist the holding of the suction grippers on the transfer cylinder or drum and positively define the register of the sheet being reversed and transported between adjacent printing stations.

In accordance with a feature of the invention, a single pin can be used, located centrally within a suction gripper end portion; or a plurality of pins, as required by the type of printing stock to be handled.

DRAWINGS

FIG. 1 is a schematic illustration of a sheet reversal and transport apparatus to transport printing stock or substrates between two printing stations; and FIG. 2 is a fragmentary axial sectional view illustrating the gripping system, to a greatly enlarged scale, and omitting all apparatus which are conventional, and does not form part of the present invention.

DETAILED DESCRIPTION

Figure 1:
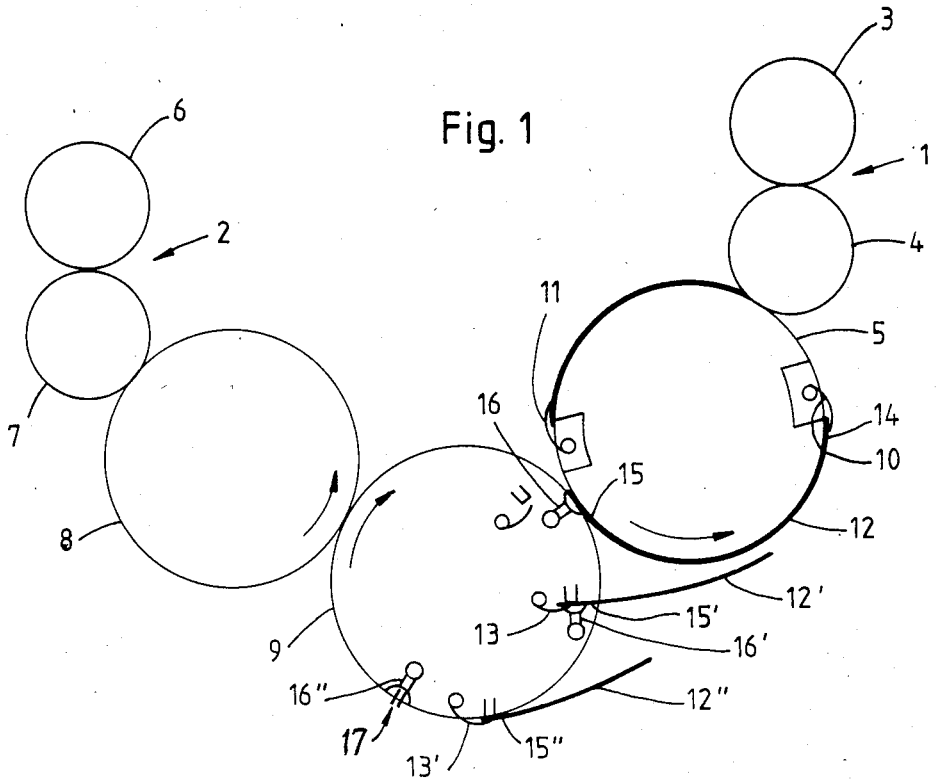
Figure 2:
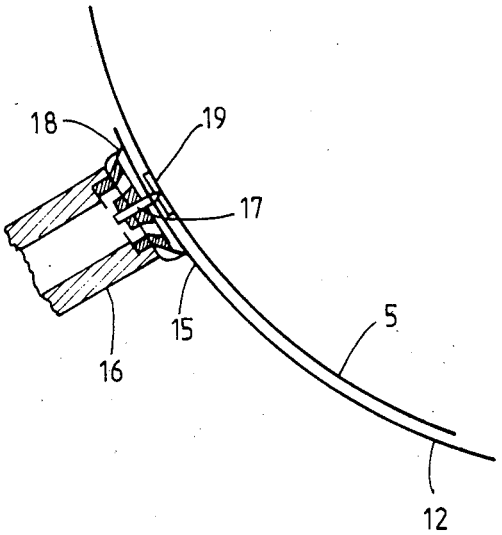

A first printing station 1 has a plate cylinder 3, a rubber blanket cylinder 4, and an impression cylinder 5. Sheets 12 are being transported from the first printing station 1 to a second printing station 2, likewise having a plate cylinder 6, and blanket cylinder 7, and an impression cylinder 8. The impression cylinders 5, 8 have twice the diameter of the blanket and plate cylinders 4, 7; 3, 6, respectively. The printing stations are identically constructed, and only one is shown in greater detail since the other is the same, for simplicity of the drawing. Sheets are reversed and transported between the printing stations 1, 2 by a reversal and transport cylinder or drum 9.

The impression cylinders 5, 8 each have cylinder grooves in which mechanical grippers 10, 11 are located, as schematically shown on the impression cylinder 5. These grippers are standard gripper systems, and may be constructed with any well known and suitable sheet gripper arrangement. A sheet 12, for example after having been printed in the first printing station 1, is engaged at the leading edge 14 by the grippers 10 and carried past the transfer drum 9, with slight clearance, until the trailing zone or end portion of the sheet 15 is opposite the suction grippers 16 located in one half region of the reversing and transfer drum 9. The suction grippers 16 are then placed under vacuum, so that the suction grippers 16 will engage and grip the rear or trailing zone 15 of the sheet, lifting the sheet off the surface of the impression cylinder 5. The suction grippers 16 then pivot inwardly into the drum 9, as seen at the position 16' of the suction grippers. The originally trailing edge of the sheet is then gripped by mechanical grippers 13 within the interior of the transfer drum 9, as schematically shown at 12'. The suction grippers 16 then can again pivot to the outside—see position 16''—and the mechanical grippers can carry the sheet 12 in the direction of the impression cylinder 8 of the second printing station 2, as seen at the positions 12'' and 13'. The now leading edge—previously the trailing zone 15—of the sheet can now be transferred to grippers on the impression cylinder 8—not shown for simplicity of the drawing—and which may be identical to the gripper system 10, 11 as described in connection with the impression cylinder 5. The sheet 12 can then be printed in the printing station 2 on the back or verso side thereof.

In accordance with the present invention, slippage of the sheet upon transfer by the suction grippers between the impression cylinder 5 and the reversal cylinder 9 is prevented by locating at least one pricking pin 12 on the suction grippers 16. If only one pin is used, it is preferably located in the central region of the suction grippers 16. In operation, the trailing zone 15 of the sheet 12 is gripped, and the pricking pin will penetrate or even entirely pass through the end portion of the sheet 12 being gripped. In dependence on respective lengths of sheets to be handled, the impression cylinder 9 may be formed with elastic zones or strips extending axially thereof, for example elastic strips 19, which permit penetration of pointed ends of the pricking pins 17 through the end zone 15 of the sheets 12. Such an elastic strip 17 is particularly desirable when handling thin printing stock. When handling thick stock, however, such as cardboard, carton material or the like, the pins 17 may penetrate only partially into the printing stock, while still providing for positive positioning of the sheets 12 on the suction grippers 16. The distance between the tips or pointed ends of the pins 17 and the surface of the impression cylinder 5 may be set to a fixed value, for example 1/10 mm. In such an arrangement, the elastic strips 19 need not be used, since the pointed tips of the pricking pins 17 will always be spaced from the surface of the impression cylinder and cannot touch the impression cylinder.

The number of pins can be suitably selected in dependence on the number of suction grippers available on the reversal drum 9, and the size or, rather, the weight of the sheets to be reversed and transported. Thus, a plurality of pins 17 can be associated with each suction gripper in order to provide the necessary holding force upon the transfer of the trailing portion or zone 15 of a sheet 12 from the impression cylinder 5 to the reversal drum 9. The penetrating distance of the pins 17 can readily be adjusted, for example by threading the pins 17 into a central holding nut, retained by a spider or the like, within the end or foot portion 18 of the suction gripper 16, and locking the adjusted pins 17 in position by a suitable counter locking nut or the like. A plurality of pins 17 is shown in FIG. 1 at the position of the grippers 16'' only, for clarity of the drawing.

Various changes and modifications may be made within the scope of the inventive concept.

I claim:

1. In combination with a rotary printing machine having two printing stations (1, 2);

a cylinder (4, 7) applying printed subject matter, of predetermined diameter, in each one of the printing stations;

an impression cylinder (5, 8) of double the diameter of the cylinder applying printed subject matter at each one of the printing stations;

gripper systems (10, 11) secured to the respective impression cylinders to grip a leading edge of a substrate sheet (12) passing between the respective impression cylinder and the printed subject matter applying cylinder, a sheet reversing and transport apparatus having a reversing and transport drum or cylinder (9);

suction grippers (16) formed with a suction end portion (18), located on the reversing drum or cylinder, and positioned to engage a trailing zone or region (15) of a sheet on one (5) of the impression cylinders (5, 8), and comprising, in accordance with the invention, at least one holding pin (17) located within the suction end portion (18) of the suction grippers (16) and dimensioned to at least prick the trailing zone (15) of a sheet being engaged by the suction grippers and secured by suction against the suction grippers, for positive positioning of the sheet on the suction grippers, and hence on the reversing drum or cylinder (9), and assisting the suction holding action of the suction grippers (16).

2. Apparatus according to claim 1, wherein one pin (17) is provided, located centrally within the suction end portion (18) of a respective suction gripper (16).

3. Apparatus according to claim 2, wherein said one holding pin (17) has a pointed end or tip, to form a pricking pin.

4. Apparatus according to claim 1, wherein a plurality of holding pins (17) are provided, located within the suction end portion (18) of a respective suction gripper.

5. Apparatus according to claim 4, wherein the holding pins have pointed ends or tips, to form pricking pins.

6. Apparatus according to claim 1, further including an elastic zone located on the respective impression cylinder (5) from which the trailing end portion or zone of a sheet is to be removed by the suction grippers (16, 18), said elastic strip permitting at least one of: engagement; penetration, of the end portions of the holding pins.

7. Apparatus according to claim 1, wherein said at least one holding pin has or a pointed end or tip, to form a pricking pin.

8. Apparatus according to claim 1, wherein the holding pins project from the circumference of the reversing drum or cylinder (9) by a distance leaving a clearance from the impression cylinder (5) from which a sheet is to be removed and reversed, by about 1/10 mm.

9. Apparatus according to claim 8, wherein the holding pins have pointed ends or tips, to form pricking pins.

10. Apparatus according to claim 8 further including an elastic zone located on the respective impression cylinder (5) from which the trailing end portion or zone of a sheet is to be removed by the suction grippers, said elastic strip being positioned opposite said at least one pin (17) upon rotation of the respective impression cylinder placing the suction grippers in position for removal, by suction, of the trailing zone, or region (15) of a sheet (15) on the respective impression cylinder.

* * * * *